United States Patent [19]

Ishii et al.

[11] 4,373,187

[45] Feb. 8, 1983

[54] CORRECTIVE FEEDBACK TECHNIQUE FOR CONTROLLING AIR-FUEL RATIO FOR AN INTERNAL COMBUSTION ENGINE

[75] Inventors: Toshio Ishii; Yasunori Mouri; Osamu Abe, all of Katsuta; Taiji Hasegawa, Nakaminato, all of Japan

[73] Assignee: Hitachi, Ltd., Tokyo, Japan

[21] Appl. No.: 169,753

[22] Filed: Jul. 17, 1980

[30] Foreign Application Priority Data

Jul. 20, 1979 [JP] Japan ..... 54-91536

[51] Int. Cl.[3] ..... F02B 1/06; F02M 7/16

[52] U.S. Cl. ..... 364/431.06; 123/440; 123/480; 123/489

[58] Field of Search ..... 364/431; 123/437, 438, 123/440, 489, 480

[56] References Cited

U.S. PATENT DOCUMENTS 3,689,755 9/1972 Hodgson et al. ..... 123/486
4,224,910 9/1980 O'Brien ..... 123/440
4,270,503 6/1981 Pomerantz ..... 123/438
4,279,230 7/1981 Bauer et al. ..... 123/440
4,290,107 9/1981 Suda et al. ..... 123/440 X
4,290,400 9/1981 Pomerantz ..... 123/440
4,294,212 10/1981 Aoki ..... 123/440

*Primary Examiner*—Felix D. Gruber
*Attorney, Agent, or Firm*—Antonelli, Terry and Wands

[57] ABSTRACT

In a fuel control method data used to control the amount of the fuel supply in the previous cycle is corrected in response to the output of an $O_2$ sensor in a current cycle, and added to or subtracted from the corrected data value as the difference between a value derived from data stored in a map based on the output of a vacuum sensor and engine rotation speed in the previous cycle and a value derived from the data stored in the map based on the output of the vacuum sensor and engine rotation speed in the current cycle. The sum or difference is used as current control data.

26 Claims, 13 Drawing Figures

FIG. 4
| | | | |
|---|---|---|---|
| ADR 200 | Q | R | COUNTER |
| 201 | Q | R | COUNTER |
| 202 | Q | R | COUNTER |
| 203 | $O_2$ | | |
| 204 | $V_C$ | | |
| 205 | ROTATION SPEED (N) | | |
| 206 | MAP OUTPUT | | |
| 207 | DUTY BY $O_2$ OUTPUT | | |
| 208 | MAP DATA BEFORE CHANGE | | |
FIG. 5
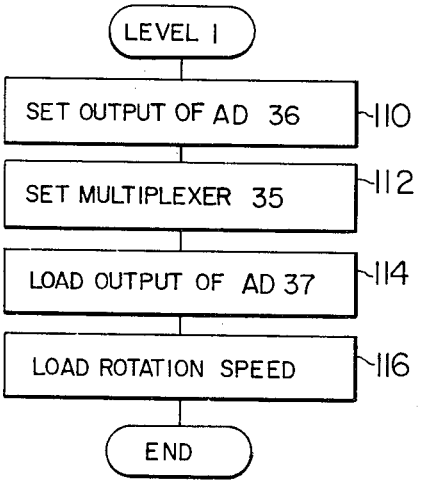
FIG. 6
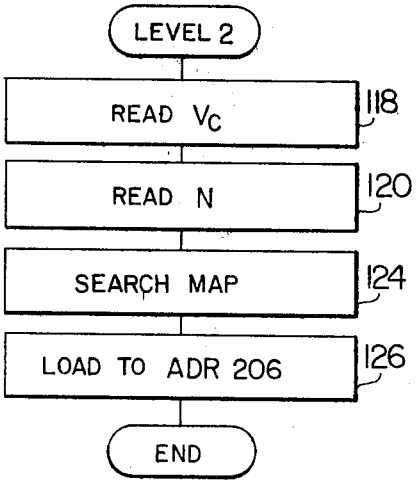

CORRECTIVE FEEDBACK TECHNIQUE FOR CONTROLLING AIR-FUEL RATIO FOR AN INTERNAL COMBUSTION ENGINE

FIELD OF THE INVENTION

The present invention relates to a method for controlling engine fuel, and more particularly to a method for controlling engine fuel in which an exhaust gas sensor is used to control the amount of fuel.

BACKGROUND OF THE INVENTION

In recent years, as the number of automobiles has increased countermeasures against air pollution have been included as part of countermeasures against public hazards from a viewpoint of environmental contamination. At the same time, countermeasures against fuel consumption have been considered from a viewpoint of energy saving. As one approach for resolving the air pollution problem, a tri-system catalyst has been frequently used. The tri-system catalyst exhibits its highest catalytic action when the air to fuel ratio of the air/fuel mixture is equal to the stoichiometric air to fuel ratio. In order to assure that the tri-system catalyst acts effectively, the air to fuel ratio has to be continuously controlled within a narrow range around the stoichiometric air to fuel ratio while the engine rotation speed of the automobile changes over a very wide range from 600 to 6000 r.p.m. and it rapidly varies. Accordingly, an exhaust gas sensor has been used to sense the exhaust gas condition.

In a system for controlling the air to fuel ratio of the engine, an $O_2$ sensor for sensing the oxygen content in the exhaust gas has been used and a detection signal of the $O_2$ sensor has been fed back for control. This air to fuel ratio control system provides a relatively stable control when the engine rotation speed is constant under certain conditions, that is, when the automobile is running at a substantially constant speed. However, as is well known, the engine is operated in various operation modes such as warming up, idling, acceleration and deceleration modes and the operation mode rapidly changes from one to the other depending on the environmental conditions. Accordingly, if the air to fuel ratio is disturbed by the rapid change of the operation mode of the engine, the disturbance may be sensed by an $O_2$ sensor coupled to the exhaust pipe. Since the time required to sense the disturbance after it has occurred is equal to a sum of the delay time of engine suction and gas exhaust, a waste time L for the exhaust gas to flow through the exhaust pipe and reach the $O_2$ sensor and a time T from the arrival of the exhaust gas change due to the disturbance to the $O_2$ sensor to the generation of an electromotive force by the $O_2$ sensor (i.e., the time constant of the $O_2$ sensor), the feedback control by the simple $O_2$ sensor cannot follow the rapidly changing operation mode.

Accordingly, in order to compensate for the delay of the detection of the exhaust gas by the $O_2$ sensor and improve the stability of the control, it has been proposed to convert the output waveform of the $O_2$ sensor to a waveform including a proportional component and an integration component to effect a proportional-integral control. This approach, however, is not sufficient to precisely follow the complex operation mode of the engine.

SUMMARY OF THE INVENTION

It is an object of the present invention to provide a method for controlling the supply of engine fuel which precisely controls the air to fuel ratio under rapid changes of the operational mode of the engine.

In accordance with a feature of the present invention, the amount of fuel supply to the engine is corrected in accordance with the condition of the exhaust gas, and the difference between the fuel control signal derived from a prior operation condition and a current fuel control signal is calculated (or determined) in order to correlate the amount of fuel supply to the change of operation condition of the engine. The amount of fuel supply corrected in accordance with the condition of exhaust gas is further corrected by the difference calculated.

The principal concept is that if the operation condition does not change, a new amount of fuel supply is calculated by correcting the amount of fuel supply previously fed by the output of the exhaust gas sensor, and if the operation condition changes, the amount corrected in accordance with the output of the exhaust gas sensor is used as base data because the amount of fuel supply for the past operation condition should have been corrected to an optimum amount by the output of the exhaust gas sensor. The base data is then corrected by the control amount of fuel corresponding to the change in the operation condition.

BRIEF DESCRIPTION OF THE DRAWINGS

The preferred embodiments of the present invention will be described below in conjunction with the accompanying drawings.

FIG. 4 shows memory contents of a RAM and memory locations thereof;

FIG. 5 shows a level one flow chart;

FIG. 6 shows a level two flow chart;

DETAILED DESCRIPTION

Figure 1:
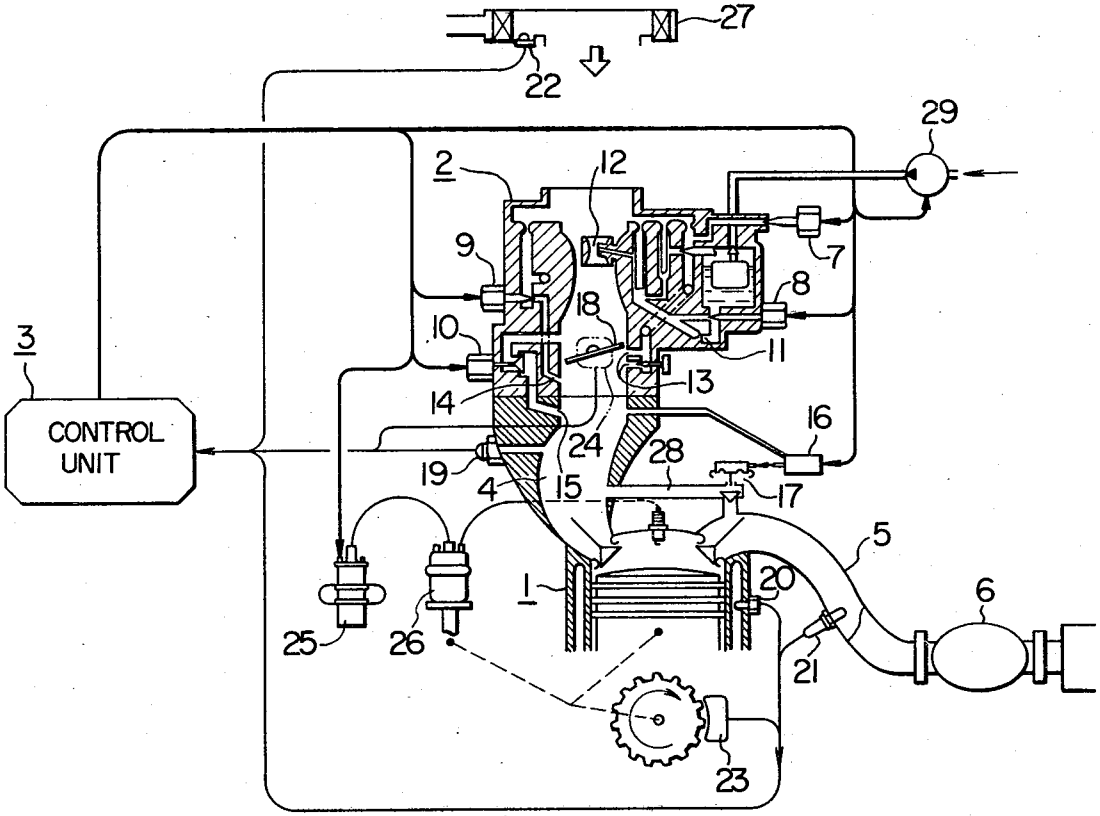
FIG. 1 shows a configuration of peripheral equipment of an engine.

FIG. 1 shows the configuration of the engine. In FIG. 1, numeral 1 denotes the engine, 2 a carburetor, 4 a suction pipe, and 5 an exhaust pipe. By displacing an accelerator pedal, not shown, the opening of a throttle valve 18 disposed in the carburetor 2 is controlled so that the flow rate of air supplied to each cylinder of the engine from an air cleaner 27 is controlled. The throttle valve 18 is provided with a throttle valve opening sensor or simply valve opening sensor 24 for producing a signal indicative of the opening of the throttle valve. This signal is supplied to a control unit 3.

The air flow rate controlled by the opening of the throttle valve 18 is sensed by a pressure sensor 19 disposed in the suction pipe 4 as the magnitude of suction vacuum. This suction vacuum signal is applied to the control unit 3. Based on the suction vacuum signal and output signals from various sensors to be described later, the openings of solenoid valves 7, 8, 9 and 10 disposed in the carburetor 2 are controlled.

The fuel supplied from a fuel pump 29 is fed to the carburetor 2 from a main nozzle 12 through a main jet nozzle 11. Apart from the above supply system, the fuel is fed to the carburetor 2 from the main nozzle 12 through the main solenoid valve 8 while bypassing the main jet nozzle 11. Accordingly, the amount of fuel supplied from the main nozzle 12 can be controlled by the opening duration of the main solenoid valve 8. The fuel is further supplied from a slow fall bypass hole 13. The amount of fuel supplied therethrough can be controlled by changing the opening duration of the slow solenoid valve 7 to control the air flow rate through an air intake port.

The fuel solenoid valve located at the carburetor 2 functions to increase the amount of fuel supplied and it is energized when a large amount of fuel is necessary such as at the start of the engine or during warm up. By controlling the fuel solenoid valve 9, fuel is supplied from the opening 14.

The air solenoid valve 10 located at the carbureter 2 functions to control the amount of air fed to the engine 1, the air being supplied from the opening 15.

The valve opening times of the solenoids valves 7, 8, 9 and 10 are controlled for the engine control, such as the air to fuel ratio control and warming up operation, so that the amounts of air and fuel are finely controlled.

Numeral 17 denotes an exhaust gas recycle (EGR) valve, which is a control valve for taking out a portion of exhaust gas burnt in the cylinders of the engine and exhausted to the atmosphere through the exhaust pipe 5 and the tri-system catalyst 6, from the exhaust pipe 5 and recirculating it to the suction pipe 4 by an EGR pipe 28 connected to the EGR valve 17. The recirculation of the exhaust gas is effected to improve the exhaust gas. The recirculation ratio of the exhaust gas is controlled by the EGR valve 17 and an EGR solenoid 16 which controls the EGR valve 17.

Numeral 25 denotes the ignition coil, and 26 denotes the distributor. Control of the ignition and ignition timing is effected by a control signal from the control unit 3. This control is based on a detection signal which depends on the engine rotation speed supplied to the control unit 3 by a crank angle sensor 23 which comprises a reference angle generator and a position signal generator.

Numeral 20 denotes a coolant temperature sensor and 22 denotes a suction air temperature sensor. The former is used to provide a correction signal for increasing the concentration of the fuel in order to rapidly raise the engine temperature immediately after the start of the engine while the latter produces a correction signal for the engine control, which signal is given to the control unit 3.

Numeral 21 denotes an $O_2$ sensor which is one of the important sensors for the control of the present invention. It functions to sense the oxygen content in the exhaust gas to optimize the air to fuel ratio.

Figure 2:
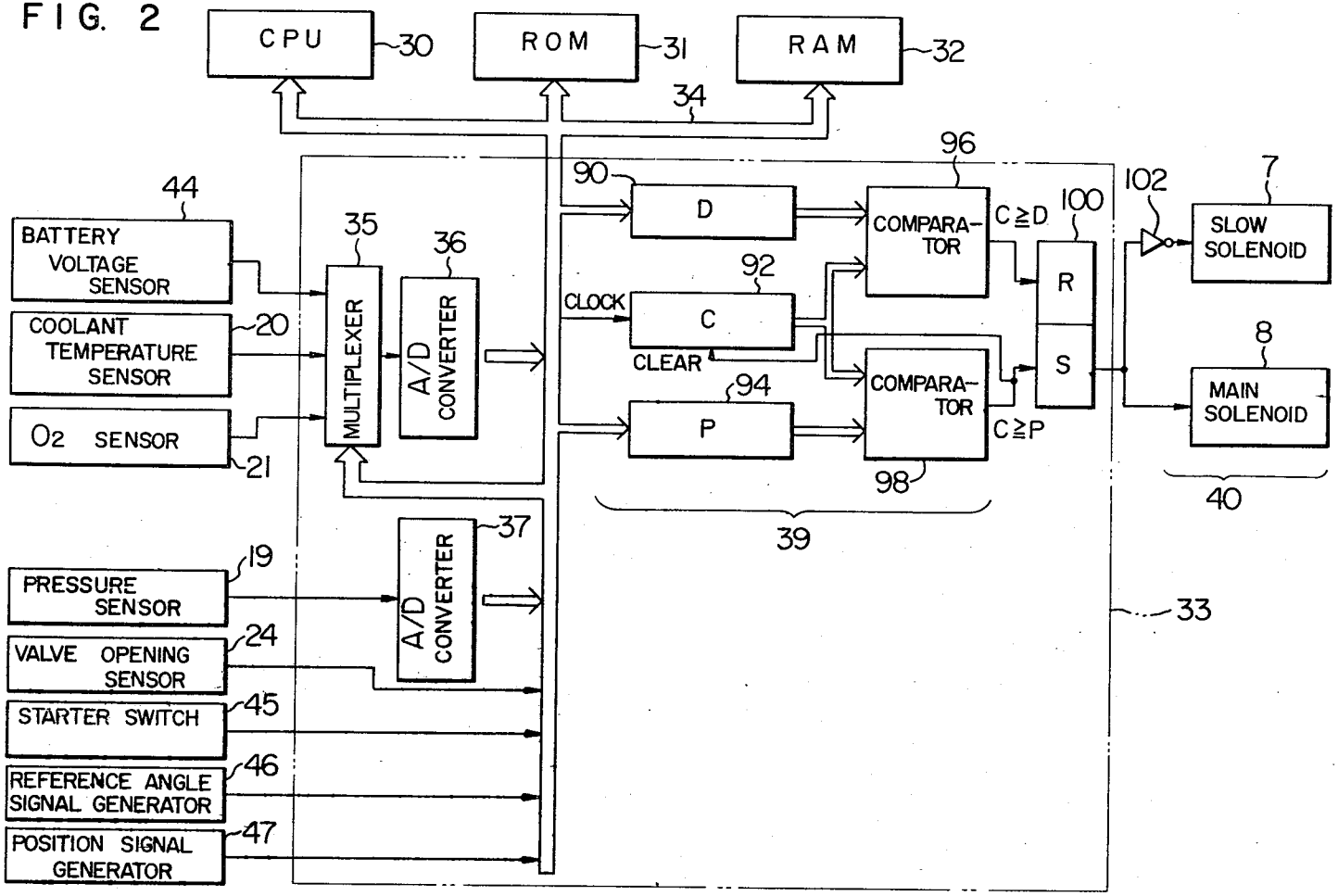
FIG. 2 shows a configuration of a control system for controlling the engine.

Data necessary for the engine control are supplied to the control unit 3 so that the engine is controlled by a control instruction from the control unit 3, which is shown in FIG. 2. That is, FIG. 2 shows the configuration of the control unit 3 for the engine having the carburetor.

In FIG. 2, the control unit 3 comprises a central processor (CPU) 30, a read only memory (ROM) 31, a randam access memory (RAM) 32 and an I/O control unit 33. The CPU 30 issues instructions for selectively receiving a multiplicity of external information necessary for the control of the operation to be described later and executes arithmetic operations in accordance with the contents of the ROM 31 which stores a system control program and various data and the contents of the RAM 32.

The I/O control unit 33 comprises a digital switch 35 (e.g., a multiplexer) which switches a multiplicity of information signals from the external devices in accordance with selection commands, A/D converters 36 and 37 for converting the selected analog information to digital information and a control logic circuit 39 for applying the digital information to the CPU 30 to cause it to execute arithmetic operations in accordance with the contents stored in the ROM 31 and providing control signals to the external control unit.

What is controlled by the result of the arithmetic operation of the CPU 30 is an air to fuel ratio control unit 40 which comprises the slow solenoid valve 7 and the main solenoid valve 8 shown in FIG. 1. The amounts of air and fuel which determine the air to fuel ratio are controlled by the open periods of the valves 7 and 8.

The amount of fuel of the engine is controlled, as a whole, in accordance with input information described below. A battery voltage sensor 44 senses the change in battery voltage. The coolant temperature sensor 20 produces a signal which is a principal parameter during the idling operation. It is used to raise the concentration of the air-fuel mixture when the coolant temperature is low to render the engine to be operated at a high rotation speed. The coolant temperature signal is also used to control the air to fuel ratio and the exhaust gas recirculation.

The opening aperture sensor 24 and the pressure sensor 19 function to control the amount of recirculation of the EGR control unit and the air to fuel ratio of the air to fuel ratio control unit. The $O_2$ sensor 21 (exhaust gas sensor) senses the oxygen content in the exhaust gas to optimize the air to fuel ratio.

A starter switch 45 produces a signal when the engine starts which is used as a conditioning signal after the engine has started.

The reference angle signal generator 46 and the position signal generator 47 are included in the crank angle sensor 23 shown in FIG. 1, and they generate signals for every reference angle of crankshaft rotation, e.g. at every 180° position and 1° position respectively. Since they relate to the rotational speed of the engine crankshaft, they represent data relating to the ignition control unit as well as various other units to be controlled.

The signals from the battery voltage sensor 44, the coolant temperature sensor 20 and the $O_2$ sensor 21 are applied to the multiplexer 35 and a selected one of them is applied to the A/D converter 36 and resulting digital data is applied to the CPU 30 via a bus line 34. The output from the pressure sensor 19 is converted into digital data by the A/D converter 37. The result of the arithmetic operation in the CPU is loaded in a register 90. Data representative of a constant frequency signal is loaded in a register 94. A clock signal from the CPU 30 is applied to a counter 92 which counts up the clock signals. When the contents of the counter 92 become equal to or greater than the contents of the register 94, a comparator 98 produces an output which sets a flip-flop 100 and clears the counter 92. As a result, the slow solenoid 7 receives an "L" output from an inverter 102 while the main solenoid 8 receives an "H" output. When the output C of the counter 92 becomes larger than the output D of the register 90, the flip-flop 100 is reset. As a result, the slow solenoid 7 receives the "L" signal from the inverter 102 while the main solenoid 8 receives the "H" signal. Accordingly, the "H" duty of the main solenoid 8 and hence the valve opening rate is determined by the content of the register 90 while the "L" duty of the slow solenoid 7 and hence the valve closing rate is determined thereby.

The input data described above must rapidly respond to the rapidly changing operation conditions of the automobile in order to precisely control engine operation. The control process of the control unit shown in FIG. 2 will now be explained with reference to the flow chart shown in FIG. 3.

First, a timer interruption request (IRQ) is issued to start responsive tasks to execute the tasks having a high priority. More particularly, when the CPU receives an interruption request, it determines at a step 50 if the interruption is a timer interruption and if it is a timer interruption the CPU selects, at a step 51, one of the tasks which are grouped in the order of priority, by a task scheduler and executes the selected task at a step 52. At a step 53, when the execution of the selected task is completed, the CPU again goes back to the step 51 where it selects the next task by the task scheduler.

If the interruption is an engine stop interruption, the fuel pump is stopped at a step 54 and the ignition system is reset. At a step 55 the I/O control unit is rendered NO-GO.

Figure 3:
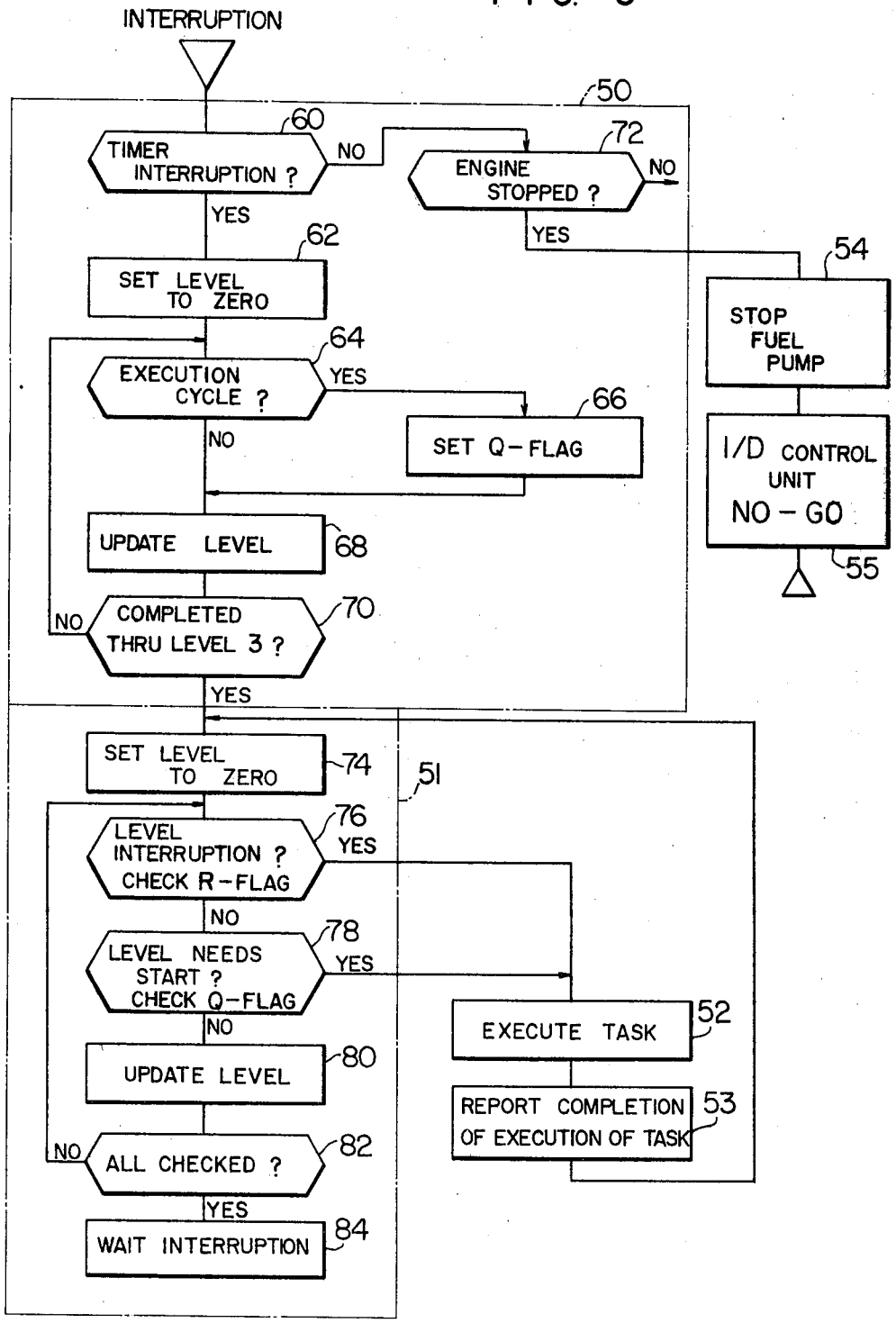
FIG. 3 shows a flow chart illustrating a priority execution of a task by an interruption signal.

Table 1 shows details of the tasks grouped which are to be selected at the step 51 of the flow chart shown in FIG. 3. As seen from Table 1, the respective tasks are grouped in the order of priority as shown by levels 1 to 3 and starting timing is established depending on the priority. In the present embodiment, the starting timings of 10 milliseconds, 20 milliseconds and 40 milliseconds are established in the order of priority.

TABLE 1

| Level | Task | Function | Starting Timing |
|---|---|---|---|
| | AD1 | Process by AD converter 1 | 10 ms |
| 1 | AD2 | Process by AD converter 2 | 10 |
| | RPMIN | Input of engine rotation speed | 10 |
| 2 | CARBC | Flat control of air to fuel ratio | 20 |
| 3 | LAMBDA | Feedback control of $O_2$ | 40 |

The present embodiment will now be explained.

In FIG. 3, steps 62–70 determine if the starting timing of the Table 1 has been reached. If it has, a Q-flag of a corresponding level in RAM shown in FIG. 4 is set to "1" at a step 66. In FIG. 4, address ADR 200 corresponds to the level 1, ADR 201 corresponds to the level 2 and ADR 202 corresponds to the level 3. The counter bits of the ADR 200–202 are software timers which are updated for each timer interruption to determine the timing of Table 1.

The steps 74–82 determine what level of program is to be executed. Through the execution of it, the step 52 resets the Q-flag and sets an R-flag. After the completion of the task of that level, the step 53 resets the R-flag.

FIG. 5 shows a level 1 flowchart which is executed every 10 milliseconds as shown in Table 1. At a step 110, the output of the $O_2$ sensor is loaded to the ADR 203 of the RAM through the A/D converter 36. Then the multiplexer channel selects the next sensor. At a step 114, digital data from the vacuum sensor is loaded into the address 204 of the RAM. At a step 116, the rotation speed of the output shaft of the engine is detected and it is loaded to the ADR 205 of the RAM.

FIG. 6 shows a level 2 flow which is executed every 20 milliseconds as shown in Table 1. At a step 118, the value of the vacuum pressure is read out of the ADR 204 of the RAM, and at a step 120, N is read out of the ADR 205 of the RAM. At a step 124, a map of the fuel valve open periods (on-duty) in the ROM 31 is searched in accordance with the read out values and the retrieved data is loaded in the ADR 206 at a step 126.

Figure 7:
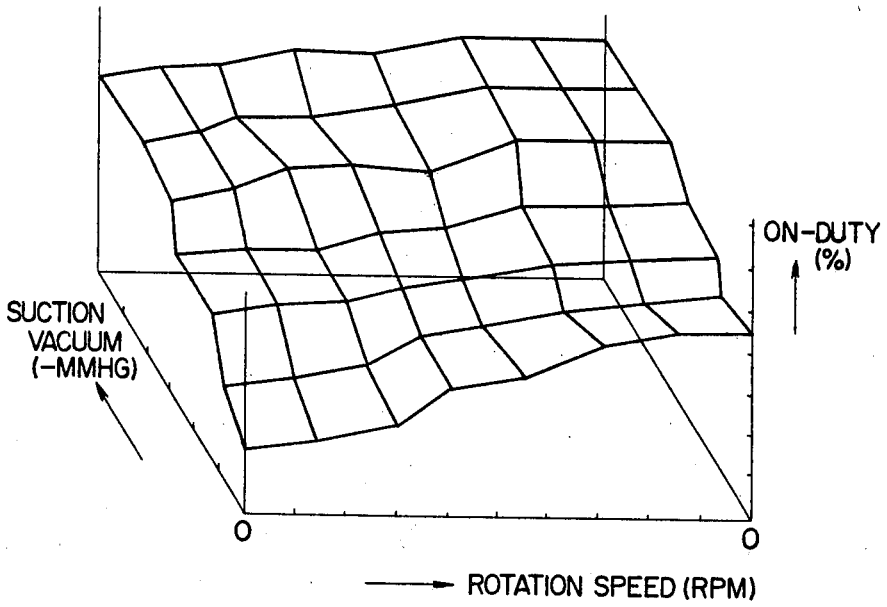
FIG. 7 shows a flat map of air to fuel ratio.

The solenoid valves 7 and 8 of the carbureter for supplying fuel are energized by pulses so that the fuel to be supplied is controlled by the valve open periods (on-duty) of the respective solenoid valves. As shown in FIG. 7, this on-duty control is effected by presetting the on-duty factors (percents) of the respective solenoid valves such that the air to fuel ratio is equal to the stoichiometric air to fuel ratio under a condition determined by the engine rotation speed (N) and the suction vacuum (VC) sensed by the pressure sensor 19 and the position sensor 24 and calculating the on-duty factors based on the on-duty preset factors and the on-duty factors which are calculated based on the feedback signal from the $O_2$ sensor. The on-duty factors shown in FIG. 7 are called an air to fuel ratio flat map. The on-duty factors for the respective solenoid valves determined by the flat map are stored in the control unit. These factors are searched as shown in flowchart in FIG. 6.

Figure 8:
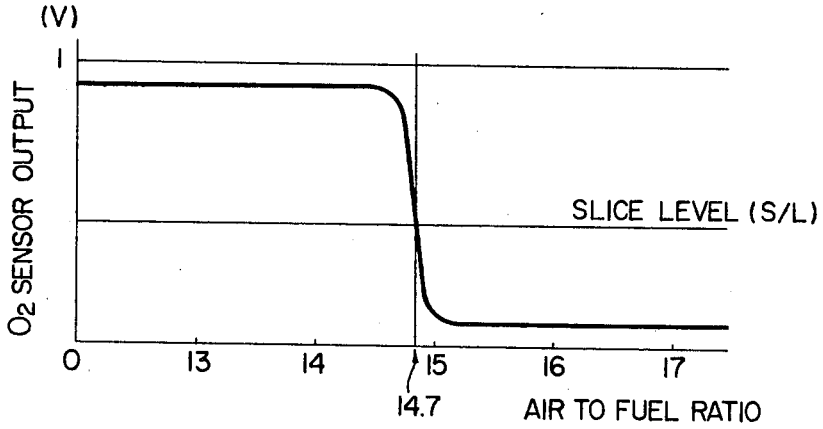
FIG. 8 shows the change of an output of an $O_2$ sensor.

The $O_2$ sensor is a type of oxygen concentration cell, the electromotive force of which abruptly changes near the stoichiometric air to fuel ratio of 14.7 as shown in FIG. 8. In a conventional method for controlling the air to fuel ratio by feeding back the $O_2$ sensor signal, the rich or lean condition of the air to fuel ratio is determined; if it is rich, the duty cycle of the solenoid valve is gradually reduced and if it is lean, the duty cycle is gradually increased, so that a closed loop control is effected to assure that a mean air to fuel ratio is equal to the stoichiometric ratio of 14.7.

Figure 9:
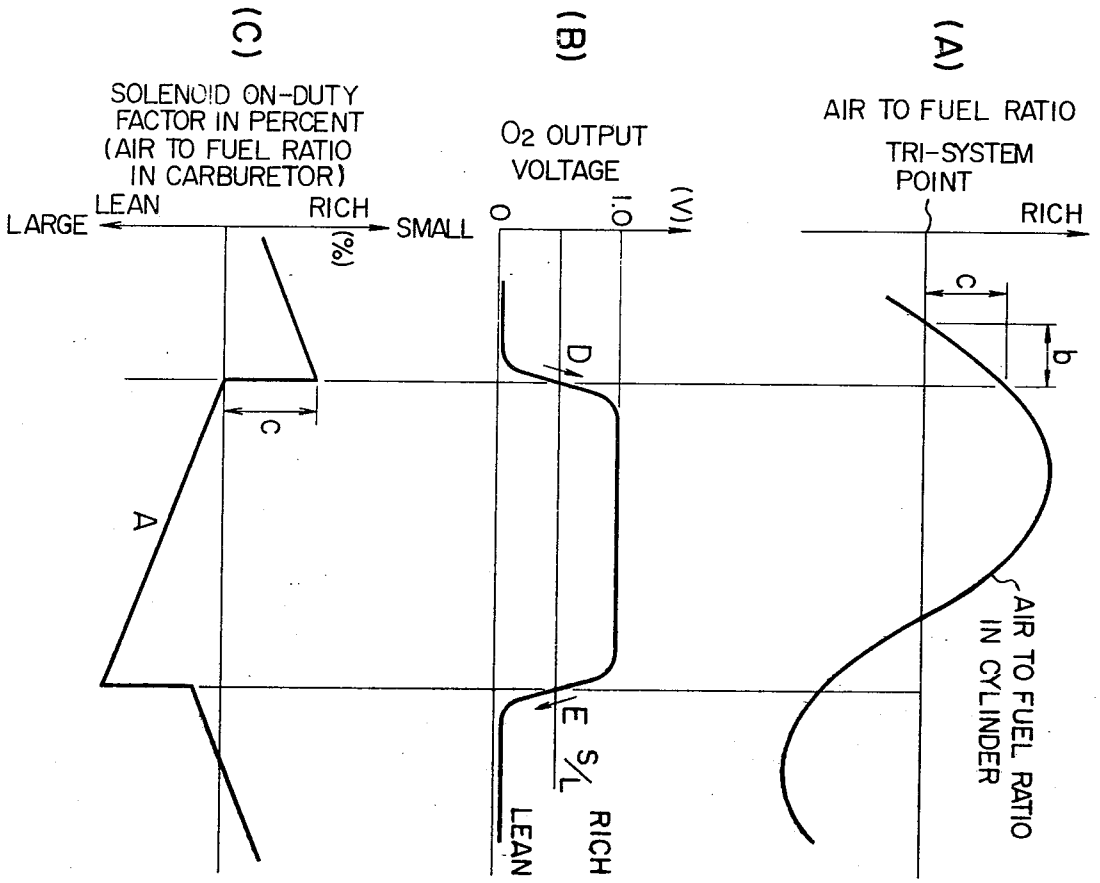
FIG. 9 shows the relationship between the air to fuel ratio in a cylinder and the on-duty ratio.

However, the output voltage from the $O_2$ sensor for the air to fuel ratio in the cylinder is delayed by a time period b as shown in FIGS. 9(A) and (B). Accordingly, the output voltage waveform of the $O_2$ sensor shown in FIG. 9(B) is converted to a waveform having a proportional correction component C and an integration gradient A as shown in FIG. 9(C) to compensate for the delay in order to determine the duty cycle based on the waveform shown in FIG. 9(C) such that the average of the air to fuel ratio is controlled by this duty cycle.

The embodiment of the present invention operates according to the combination of the duty control based on the flat map and the feedback control based on the $O_2$ sensor. The control method will now be explained with reference to the flow chart shown in FIG. 10.

When the tasks are started at a fixed cycle, e.g. every 40 milliseconds, a step 150 determines if it is an air to fuel ratio control loop or a closed loop. If it is determined to be a non-closed loop at the step 150, a step 151 determines if the engine coolant temperature is equal to or above 40° C., and if it is not, a step 154 clears the closed loop flag and a step 155 loads a value from the air to fuel ratio flat map to an actuator (to determine the duty cycle of the solenoid value). This operation is repeated until the engine coolant temperature reaches the predetermined temperature (40° C.).

When a step 151 determines that the engine coolant temperature is equal to or higher than the predetermined temperature or 40° C., a step 152 determines if it is immediately after starting or not; if the answer is yes, step 153 sets a wait counter to wait until the temperature of the $O_2$ sensor rises to an activation temperature (for about 10 seconds in the present embodiment). For this period, the air to fuel ratio control is effected by the duty cycle control based on the flat map value as in the previous case. Even during the operation of the wait counter at the step 153, the flat map value is read at a step 155 and it is loaded into the register 90 shown in FIG. 2. In this manner control based on the flat map is effected. This flat map value is also loaded to the address 207 of the RAM at a step 180. In this manner, the open loop control or the flat map control is effected from the time immediately after the start of the engine through the period of temperature rise of the coolant to the time at which the $O_2$ sensor can fully function.

When a step 156 determines the completion of the counting operation of the wait counter, a step 157 starts an oscillator unit (not shown). The oscillator unit forcibly and periodically changes the duty output for cleaning and stabilizing the $O_2$ sensor, so as to intentionally change the $O_2$ sensor output to the voltages corresponding to the rich and lean conditions. After the step 157 has set the oscillator unit, a step 158 determines if the variation of the output exceeds a predetermined range, and, if yes, a step 159 sets a closed loop control start flag. At the next step 160, the operation of the oscillator unit is stopped.

When the step 150 determines that the control loop is a closed loop, a step 161 determines if the amplitude of the $O_2$ sensor is lower than a predetermined level or not and, if it is higher than the predetermined level a step 162 determines if the $O_2$ sensor has been on one side (rich or lean side) for a predetermined time period or longer. That is, it determines if the $O_2$ sensor is in an abnormal state or not. If the step 162 determines that the $O_2$ sensor has been in the rich or lean side for the predetermined time period or longer, that is, the $O_2$ sensor is in an abnormal state, the control is immediately switched to an open loop control and a step 154 is carried out. If the $O_2$ sensor is in the normal state, the step 163 measures the engine rotation speed and a step 164 sets a control gain which corresponds to the rise of the portion C and the gradient of the portion A shown in FIG. 9(C). The setting of the control gain at the step 164 is effected to compensate for the delay of the detection by the $O_2$ sensor and enhance the stability of the control (prevention of hunting) and the setting value depends on the engine crankshaft rotation speed.

A step 165 and the following steps are steps for converting the change of the output signal of the $O_2$ sensor shown in FIG. 9(B) to a control gain determined by the engine rotation speed, that is, to a waveform having the proportional portion C and the integration portion A shown in FIG. 9(C). The step 165 determines if the $O_2$ sensor output is equal to or higher than a slice level S/L based on FIGS. 9(B) and (C), and if the $O_2$ sensor output is equal to or higher than the slice level S/L, a step 169 determines if the direction of change is to the lean state or to the rich state. When it determines that the direction of change is from the lean state to the rich state (arrow D shown in FIG. 9(B)), a step 171 substracts a value corresponding to the proportional portion C at a time point of the change from the lean state to the rich state from the content at the address 207 of the RAM. If the step 169 determines that the state has remained in the lean state, a step 170 subtracts a value corresponding to the integration portion A from the content of the address 207 of the RAM.

If the step 165 determines that the $O_2$ sensor output does not reach the slice level S/L, a step 166 determines if the $O_2$ sensor output has changed in the direction from the rich state to the lean state with respect to the slice level S/L or not, and if it determines that the $O_2$ sensor output has changed in the direction from the rich state to the lean state (an arrow E shown in FIG. 9(B)), a step 168 adds the value corresponding to the proportional portion C to the content of the address 207 of the RAM. If the step 166 determines that the state has remained in the rich state, a step 167 adds the value corresponding to the integration portion A to the content of the address 207 of the step 167.

Through this operation, the output waveform of the $O_2$ sensor is converted to the waveform shown in FIG. 9(C). Basically the duty control of the solenoid values is effected based on this waveform, but when the operation condition of the engine, that is, acceleration or deceleration condition changes abruptly, the following steps prevent the delay of the air to fuel ratio control due to an abrupt change of the operation condition.

A step 172 calculates a change in the air to fuel ratio map due to an abrupt change of the operation condition of the engine and a step 173 adds this change to the on-duty value determined by the signal from the $O_2$ sensor. A step 174 loads the sum to the register 90 shown in FIG. 2 which functions as the actuator.

The air to fuel ratio control for an abrupt change of the operation condition of the engine will now be explained in more detail.

Figure 10:
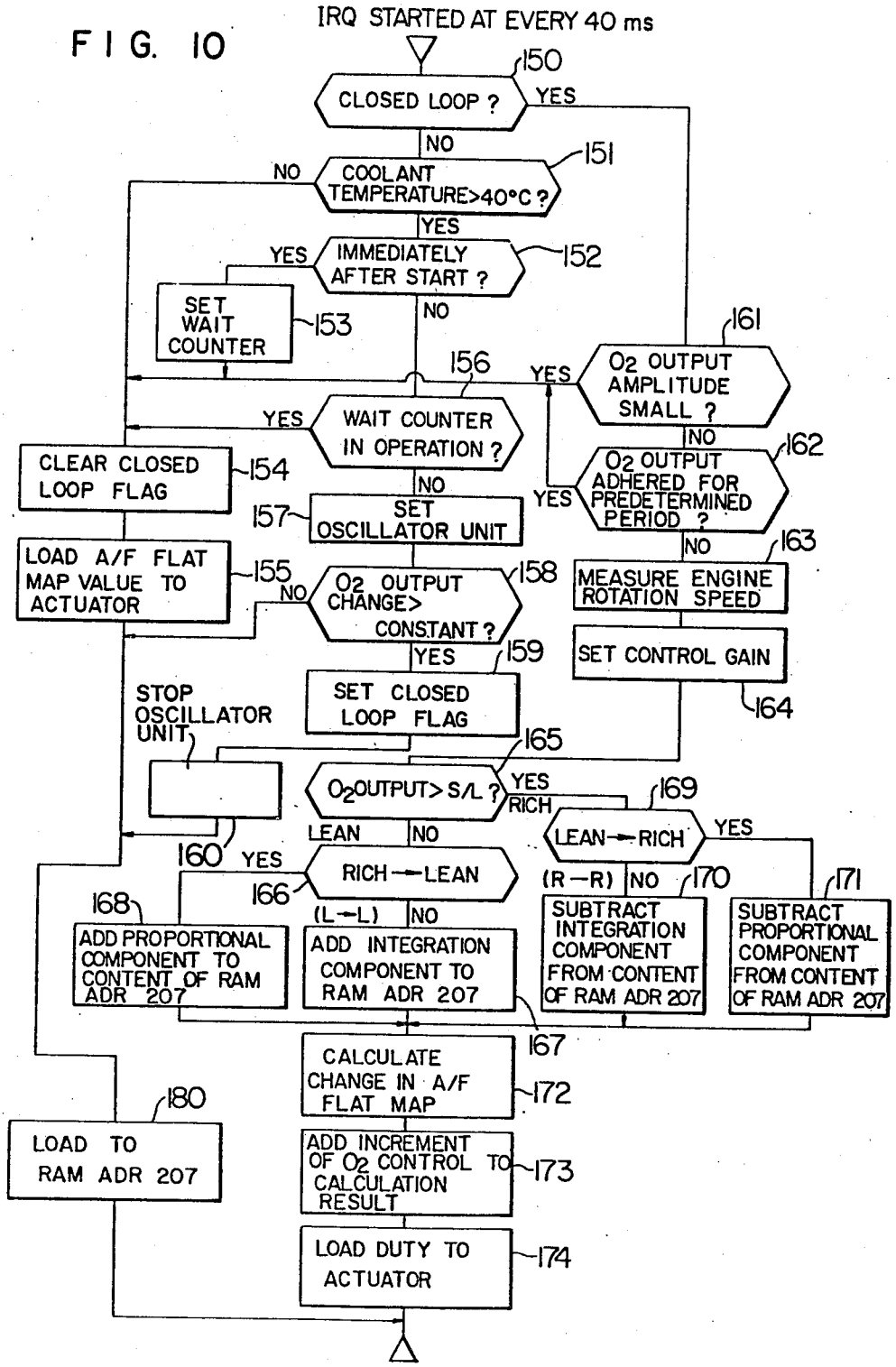
FIG. 10 shows a flow chart illustrating one embodiment of the present invention.
Figure 11:
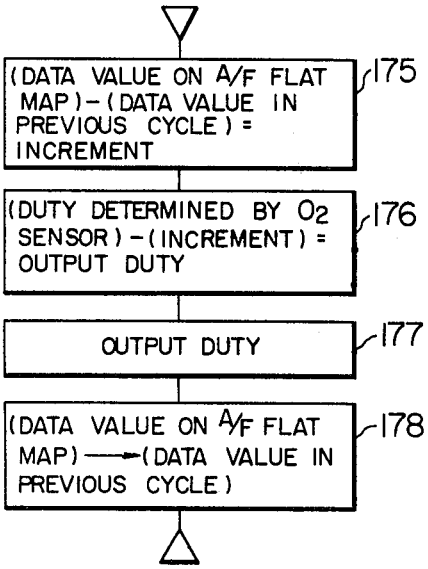
FIG. 11 is a flow chart showing further detail of the embodiment shown in FIG. 10.
Figure 12:
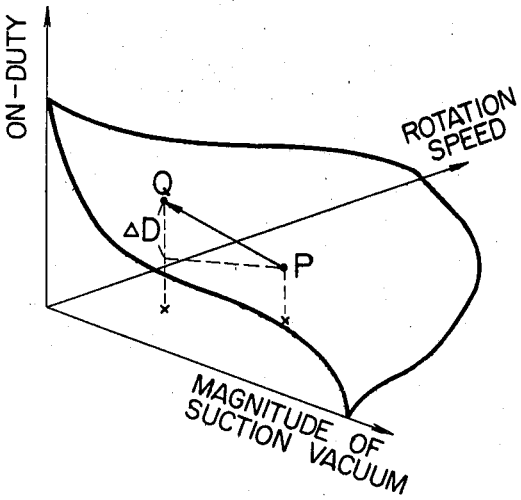
FIG. 12 shows a flat map of the air to fuel ratio.

FIG. 11 shows details of the steps 172, 173 and 174 shown in FIG. 10. Assuming that the operation condition has changed from a point P to a point Q on the air to fuel ratio flat map shown in FIG. 12 due to an abrupt change of the operation condition, a step 175 in FIG. 11 calculates an increment $\Delta D$ between the data at the point P on the air to fuel ratio flat map and the data at the point Q on the air to fuel ratio flat map and a step 176 adds the map increment $\Delta D$ to the content of the address 207 of the RAM which represents the duty determined by the $O_2$ sensor. A step 177 loads the sum which represents the duty output to the register 90 which functions as an external actuator (i.e. the solenoid valve in the present embodiment). The data at the point Q is temporarily stored at the address 208 of the RAM for use as the past data in the calculation for the next timer interruption.

Figure 13:
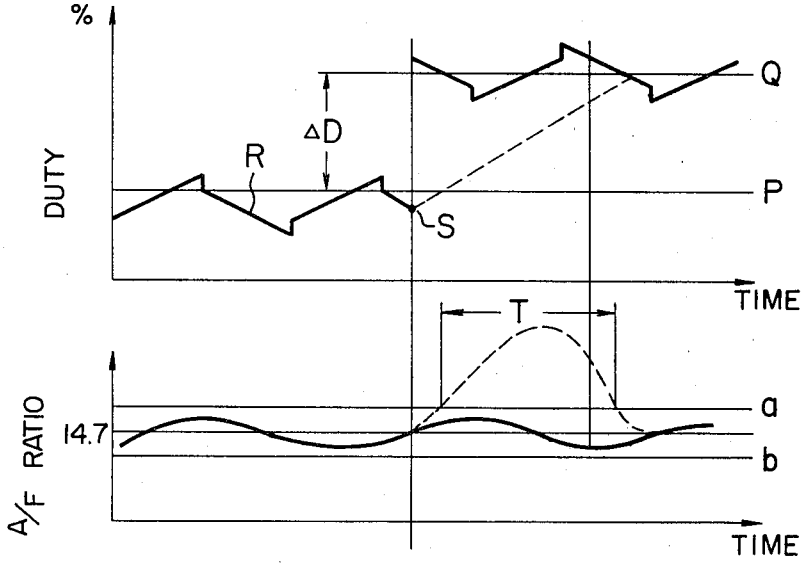
FIG. 13 shows waveforms illustrating changes of operation conditions in the embodiment shown in FIG. 10.

The above operation is clear from the relation shown in FIG. 13. A waveform R for effecting the duty control based on the signal of the $O_2$ sensor is generally controlled around the duty value at the level P on the flat map. If the state changes from level P to level Q at a point S, the increment ΔD between the points P and Q is calculated and it is immediately added to the waveform R which is duty-controlled by the $O_2$ sensor. Accordingly, after the change, the duty control is effected around the point Q.

On the other hand, if the conventional feedback control using only the $O_2$ sensor is used when the operation condition changes from P to Q, a time delay due to the integration gradient occurs from the abrupt change to the start of a normal air to fuel ratio control. This means that the air to fuel ratio control within an allowable range a-b around the stoichiometric air to fuel ratio is interrupted for a time period T by the abrupt change from P to Q.

In accordance with the present embodiment, the primary duty control is effected based on the feedback signal from the $O_2$ sensor. The on-duty factor (percent) calculated from the air to fuel ratio flat map is previously stored in the ROM and the operation condition of the engine is monitored by the map, and the increment calculated is added to the duty factor determined by the signal from the $O_2$ sensor. Accordingly, even if the operation condition changes abruptly, the air to fuel ratio control can readily follow the change.

As a result, in accordance with the present embodiment, unnecessary components in the exhaust gas do not exceed the allowable level under any abrupt change of the operation condition.

Furthermore, in accordance with the present embodiment, even immediately after the start of the engine, that is, even when the coolant temperature has not risen to a proper temperature and the $O_2$ sensor, by its natural operation, cannot produce a stable detection output immediately after the start of the engine, the air to fuel ratio is controlled based on the data on the flat map. If the $O_2$ sensor is in an abnormal state such as due to a break in the wire during the normal operation of the engine, the air to fuel ratio is automatically controlled by the flap map. Accordingly, a precise air to fuel ratio control is attained under any operation condition of the engine.

As described hereinabove, according to the present invention, the air to fuel ratio can be controlled precisely to follow abrupt changes of the operation conditions of the engine.

What is claimed is:

1. In an engine fuel control method for an engine having a combustion chamber for the combustion of fuel supplied thereto; an output shaft rotated by mechanical energy converted from thermal energy generated in said combustion chamber; a first sensor for sensing an operating condition of the engine; a second sensor for sensing a condition of exhaust gas produced by the combustion of the fuel in said combustion chamber; arithmetic means for determining a control amount of fuel based on the outputs of said first and said sensors; a drive circuit for producing a control signal in response to the output of said arithmetic means; and fuel supply means for supplying fuel in accordance with the output of said drive circuit;

said method comprising:

a first step for detecting the outputs of said first and second sensors;

a second step for determining a first value indicative of such amount of fuel supplied that assures a predetermined air to fuel ratio in said combustion chamber, based on the output of said first sensor;

a third step for correcting the amount of fuel supplied such that an air to fuel ratio close to said predetermined air to fuel ratio is established in said combustion chamber, based on the output of said second sensor; and a fourth step for applying data representing the corrected amount of fuel from said arithmetic means to said drive circuit;

an improvement wherein said third step includes:

a fifth step for increasing or decreasing the data value indicative of the amount of fuel supplied before a change of the operation condition of the engine, based on the output of said second sensor;

a sixth step for determining the difference between the second value determined in said second step based on the output of said first sensor before said change of the operation condition of the engine and the first value determined in said second step based on the output of said first sensor after said change of the operating condition of the engine; and a seventh step for increasing and decreasing the data value determined in said fifth step by the value determined in said sixth step;

the data value determined in said seventh step being applied to said drive circuit in said fourth step as a data value after said change of the operation condition of the engine.

2. In an engine fuel control method according to claim 1, further having memory means having stored therein data representing the amounts of fuel to be supplied from said fuel supply means for respective operating conditions of the engine to assure said predetermined air to fuel ratio, said data being stored in the sequence of change of said operating conditions, said second step reading out the data from said memory means as said first data value in accordance with the output of said first sensor;

an improvement wherein said sixth step determines a difference between the first value before the change of the operating condition read from said memory means in accordance with the output of said first sensor before said change of the operating condition and the first value after said change of the operating condition read from said memory means in accordance with the output of said first sensor after said change of the operating condition.

3. In an engine fuel control method according to claim 2, wherein said third step is executed at every predetermined time interval;

an improvement wherein said sixth step determines the difference between the first value after said change of the operating condition previously determined in said second step when said third step is executed and the first value before said change of the operating condition previously determined in said second step when the third step previous to said third step was executed.

4. An engine fuel control method according to claim 3, wherein said second step is executed at a second time interval shorter than said first predetermined time interval to determine said first value and store the new first value in lieu of the previously stored first value, and said sixth step determines the difference between the first value after said change of the operating condition previously stored when said third step is executed and the first value before said change of the operating state previously stored when the third step previous to said third step was executed.

5. An engine fuel control method according to claim 4, wherein said output of said first sensor is detected in said first step at a third time interval shorter than said second time interval, and the newly detected output of said first sensor is stored in lieu of the output of said first sensor detected and stored when the immediately previous third time interval has elapsed.

6. In an engine fuel control method according to claim 1, wherein said fuel supply means includes a solenoid value for changing the amount of fuel to be supplied by controlling at least one of bleed air and a fuel path and means for supplying the fuel controlled by said solenoid value into air flow by vacuum created by the air supplied to said combustion chamber of the engine, and said memory means stores duty factors of pulses to be applied to said solenoid valve corresponding to respective operating conditions in order to assure a predetermined air to fuel ratio of the air fuel mixture supplied from said air flow into said combustion chamber;

an improvement wherein said sixth step determines the difference between the duty read from said memory means before said change of the operating condition and the duty read from said memory means after said change of the operating condition, and said seventh step adds or subtracts the difference of the duties determined in said sixth step to or from the value determined in said fifth step.

7. A method of operating a processor-controlled apparatus for controlling the operation of an internal combustion engine having an air-fuel mixture supply system through which the air-fuel ratio of an air-fuel mixture is controlled and supplied to the engine, and exhaust gas sensor means for sensing a prescribed characteristic of exhaust gas emitted by said engine, comprising the steps of:

(a) storing, in memory, a data map of prescribed data values associated with air-fuel ratios of said air-fuel mixture for a plurality of values of selected engine conditions;

(b) generating an air-fuel ratio control signal for controlling the air-fuel ratio of the air-fuel mixture supplied by said supply system in accordance with the output of said exhaust gas sensor means;

(c) for a change in engine conditions, modifying said air-fuel ratio control signal in accordance with a signal representative of the difference between the data value of said data map defined by the value of said selected engine conditions prior to said change and the data value of said data map defined by the values of said selected engine conditions upon said change; and (d) supplying said modified air-fuel ratio control signal to said air-fuel mixture supply system.

8. A method according to claim 7, wherein exhaust gas sensor means comprises an oxygen sensor for sensing the oxygen content in said exhaust gas.

9. A method according to claim 7, wherein said selected engine conditions comprise engine speed and engine intake vacuum.

10. A method according to claim 7, wherein step (b) includes the step of generating said air-fuel ratio control signal in accordance with the output of said exhaust gas sensor and the data value of said data map defined by the values of said selected engine conditions.

11. A method according to claim 10, wherein step (b) comprises comparing the output of said exhaust gas sensor means with a reference level associated with the stoichiometric air-fuel ratio and controlling the characteristics of said air-fuel ratio control signal in accordance with the relationship of the output of said exhaust gas sensor means to said reference level.

12. A method according to claim 18, wherein step (b) comprises the step of causing the magnitude of said air-fuel ratio control signal to oscillate, in accordance with the relationship of the output of said exhaust gas sensor means to said reference level, about a reference signal magnitude established in accordance with said data value of said data map defined by the values of said selected engine conditions.

13. A method according to claim 12, wherein said selected engine conditions comprise engine speed and engine intake vacuum.

14. A method according to claim 13, wherein exhaust gas sensor means comprises an oxygen sensor for sensing the oxygen content in said exhaust gas.

15. A method according to claim 7, wherein said data map is a map of air-fuel mixture supply system control data values associated with the stoichiometric air-fuel ratio defined in accordance with a plurality of values of engine speed and engine intake vacuum.

16. A method according to claim 15, wherein said air-fuel mixture supply system is comprised of a low speed air-fuel mixture supply system and a medium-high speed air-fuel mixture supply system, the duties of operations of which are controlled in response to said air-fuel ratio control signal.

17. A method according to claim 16, wherein each of said low and medium-high speed air-fuel mixture supply systems includes a respective solenoid-operated valve for controlling the air-fuel ratio of the air-fuel mixture supplied thereby, the duty of operation of which is controlled in response to said air-fuel ratio control signal.

18. A method according to claim 7, further including the steps of (e) in response to a prescribed operational condition of said exhaust gas sensor means, accessing a data value from said memory in accordance with the values of said selected engine conditions and generating an air-fuel ratio control signal in accordance with said accessed data;

(f) inhibiting steps (b)–(d); and (g) supplying the air-fuel ratio control signal generated in step (e) to said air-fuel mixture supply system.

19. A method according to claim 18, wherein said prescribed operational condition of said exhaust gas sensor means corresponds to the condition of said sensor means prior to the temperature of the engine reaching a predetermined operating temperature.

20. A method according to claim 18, wherein said prescribed operational condition of said exhaust gas sensor means corresponds to the condition of said sensor means prior to the expiration of a pre-established time interval subsequent to the starting of the engine.

21. A method according to claim 18, wherein said prescribed operational condition of said exhaust gas sensor means corresponds to the condition that the output of said exhaust gas sensor means is below a predetermined level.

22. A method according to claim 18, wherein said prescribed operational condition of said exhaust gas sensor means corresponds to the condition that the output of said exhaust gas sensor means remains in the same state for a predetermined period of time.

23. A method according to claim 18, wherein said prescribed operational condition of said exhaust gas sensor means corresponds to the condition of said sensor means prior to its being purged and stabilized for operation.

24. A method according to claim 7, wherein step (b) comprises comparing the output of said exhaust gas sensor means with a reference level associated with the stoichiometric air-fuel ratio and controlling the characteristics of said air-fuel ratio control signal in accordance with the relationship of the output of said exhaust gas sensor means to said reference level.

25. A method according to claim 24, wherein exhaust gas sensor means comprises an oxygen sensor for sensing the oxygen content in said exhaust gas.

26. A method according to claim 7, wherein step (c) comprises, for a change in engine conditions, effecting a stepwise-shift of said air-fuel ratio control signal in accordance with a signal representative of the difference between the data value of said data map defined by the value of said selected engine conditions prior to said change and the data value of said data map defined by the values of said selected engine conditions upon said change.

* * * * *